United States Patent [19]

Hayashi et al.

[11] Patent Number: 4,841,447

[45] Date of Patent: Jun. 20, 1989

[54] SYSTEM FOR CONTROLLING IDLING SPEED IN INTERNAL COMBUSTION ENGINE FOR VEHICLE WITH AUTOMATIC TRANSMISSION

[75] Inventors: Kazuhiko Hayashi, Nagoya; Shigeru Kuroyanagi, Okazaki; Kunihiro Iwatsuki, Toyota, all of Japan

[73] Assignee: Toyota Jidosha Kabushiki Kaisha, Aichi, Japan

[21] Appl. No.: 866,333

[22] Filed: May 22, 1986

[30] Foreign Application Priority Data

May 22, 1985 [JP] Japan ..... 60-109746

[51] Int. Cl.[4] ..... F02M 51/00

[52] U.S. Cl. ..... 364/431.07; 123/339; 123/493; 364/424.1

[58] Field of Search ..... 364/424.1, 431.07, 431.05; 123/339, 337, 493; 74/866, 867, 868, 869, 858

[56] References Cited

U.S. PATENT DOCUMENTS

| | | | |
|---|---|---|---|
| 3,964,457 | 6/1976 | Coscia | 123/339 |
| 4,226,141 | 10/1980 | Espenschied | 74/858 |
| 4,266,447 | 5/1981 | Heess et al. | 74/858 |
| 4,305,360 | 12/1981 | Meyer et al. | 123/339 |
| 4,354,466 | 10/1982 | Dudley et al. | 123/339 |
| 4,378,766 | 4/1983 | Yamazoe et al. | 123/339 |
| 4,473,055 | 9/1984 | Ito et al. | 123/564 |
| 4,506,639 | 3/1985 | Murakami | 123/339 |
| 4,597,368 | 7/1986 | Ament | 123/339 |
| 4,627,312 | 12/1986 | Fujieda et al. | 364/424.1 |

FOREIGN PATENT DOCUMENTS

| | | |
|---|---|---|
| 58-77138 | 5/1983 | Japan . |
| 58-207556 | 12/1983 | Japan . |

*Primary Examiner*—Parshotam S. Lall
*Assistant Examiner*—V. N. Trans
*Attorney, Agent, or Firm*—Kenyon & Kenyon

[57] ABSTRACT

The engine idling speed control system in an internal combustion engine for a vehicle provided with an automatic transmission device. A shift down operation induced for attaining an engine braking effect is detected, and upon detection of such a shift down operation, the idling speed control system is controlled so that the intake air amount is incremented. As a result, an increase in an engine torque is obtained for decreasing shock during a shift down operation executed in an automatic transmission.

5 Claims, 12 Drawing Sheets

| Fig. 1A | Fig. 1B |
| --- | --- |
| Fig. 1C | Fig. 1D |

SYSTEM FOR CONTROLLING IDLING SPEED IN INTERNAL COMBUSTION ENGINE FOR VEHICLE WITH AUTOMATIC TRANSMISSION

BACKGROUND OF THE INVENTION

1. Field of the Invention

The present invention relates to a system for controlling idling speed in an internal combustion engine for a vehicle provided with an automatic transmission device, and capable of decreasing shock generated when the automatic transmission is manually operated to attain a shift down operation for engine braking to decelerate a vehicle.

2. Description of the Related Art

To attain an engine braking for decelerating a vehicle provided with an automatic transmission, usually a shift lever must be manually moved from a D position to a 2 or L position, or occasionally by switching off an overdrive switch while the throttle valve is fully closed. In this case, a large shock is generated when the automatic transmission carries out a change from a higher ratio gear to a lower ratio gear because a friction engagement unit (clutch or brake) for the lower transmission stage can transmit a torque which is excessively larger than a value of the torque from the engine itself, so that the speed of the engagement of the friction engagement unit for the lower ratio gear becomes too fast, and thus an uncontrolled change in torque in the output of the transmission device is generated.

To prevent an excessive increase in the speed of the engagement of the friction engagement unit for a low ratio gear, a simple solution can be found wherein a hydraulic pressure for the friction engagement unit is decreased to suppress any shock that will be generated during the engine braking operation. This solution, however, also prolongs the time necessary to complete a shift operation when the vehicle speed is high, causing the friction element of the friction engagement unit for the high ratio gear to be easily damaged.

To overcome these difficulties, it is possible to change the level of the hydraulic pressure for the friction engagement unit in accordance with the speed of the vehicle. With this solution, however, the construction of the hydraulic control circuit becomes complicated.

SUMMARY OF THE INVENTION

An object of the present invention is to provide an engine idling speed control system capable of decreasing the shock generated by manual operation of the automatic transmission device to attain a shift down operation for engine braking without complicating the construction of the device.

According to the present invention, a system is obtained for controlling engine idling speed for an internal combustion engine for a vehicle provided with an automatic transmission device, the engine being provided with an intake line and a throttle valve arranged therein, and the system comprising: a by-pass passageway connected to the intake line so as to by-pass the throttle valve; a valve arranged in the by-pass passageway for controlling the amount of the air passing therethrough; means for calculating the degree of opening of the valve corresponding to a present engine speed during a substantially fully closed condition of the throttle valve; means for producing a signal directed to the valve for operating the same so that the actual opening of the valve corresponds to the opening calculated by the calculating means; means for detecting a shift down operation of the automatic transmission device for attaining an engine braking effect; and, means for modifying the calculated degree of opening of the valve so that the amount of air allowed to pass therethrough is increased during the shift down operation, thereby causing the engine output torque to be increased.

DESCRIPTION OF THE PREFERRED EMBODIMENTS

Figures 1, 1A:
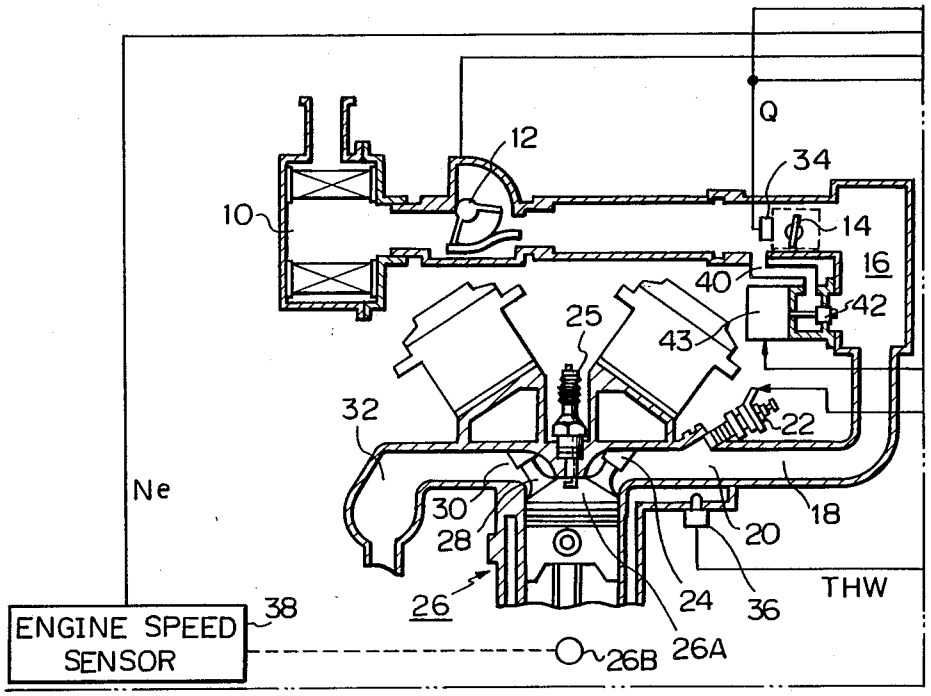
FIGS. 1A–1D constitute a schematic view of an internal combustion engine for a vehicle provided with an automatic transmission device according to the present invention.
Figure 1B:
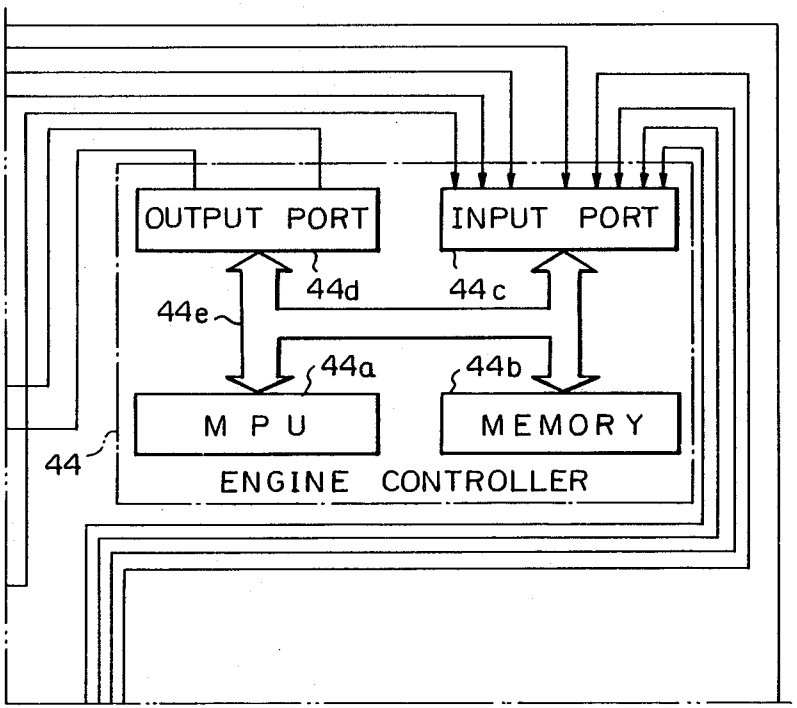
Figure 1C:
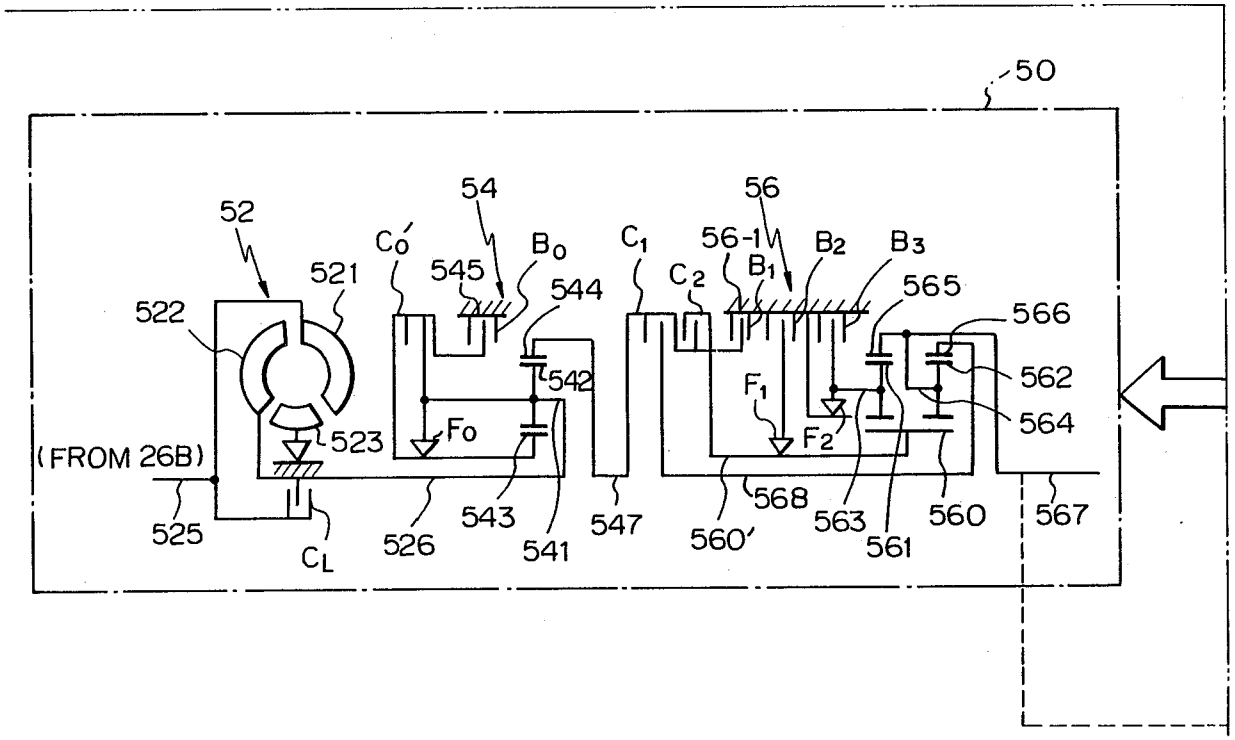
Figure 1D:
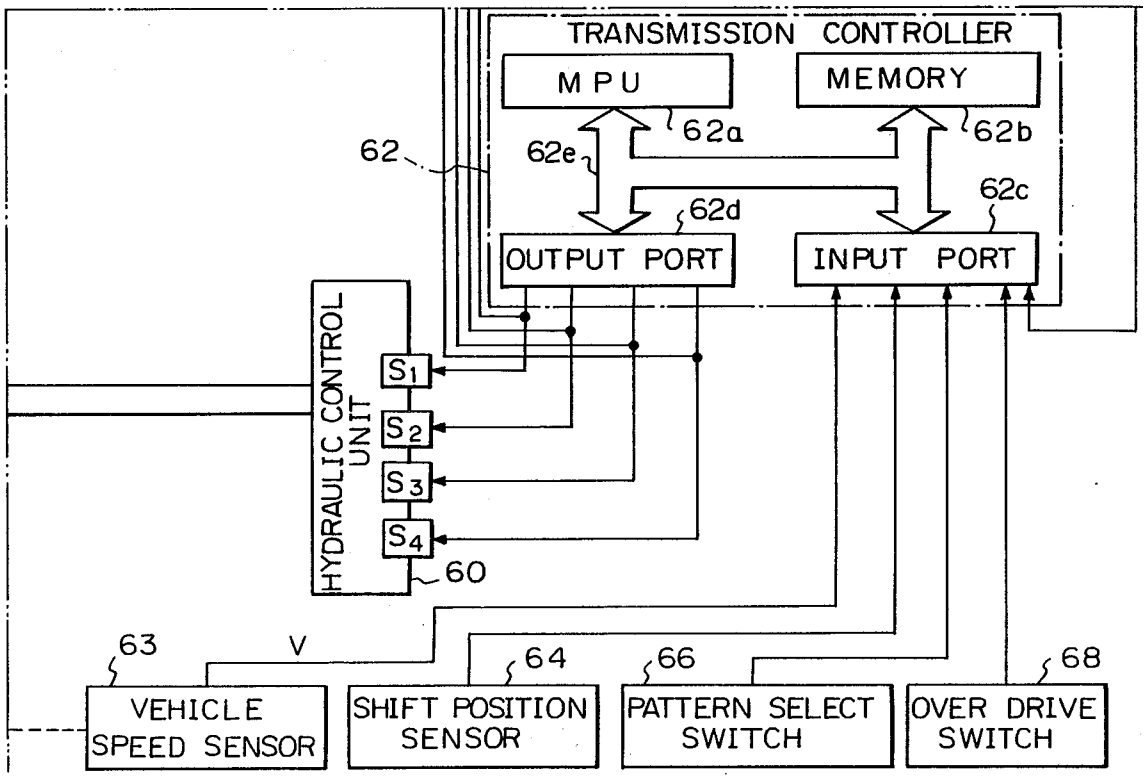

As shown in FIG. 1, air from an air cleaner 10 is introduced, via an air flow meter 12, an intake throttle valve 14, and a surge tank 16, to an intake manifold 18. At an intake port 20, the air is mixed with fuel from a fuel injector 22 to produce an air-fuel mixture which is introduced, via an intake valve 24, to a combustion chamber 26A in which a spark plug 25 is arranged for igniting the introduced combustible mixture. An exhaust gas resultant from the combustion in the combustion chamber 26A is removed by an exhaust manifold 32 via an exhaust valve 28 and an exhaust port 30.

A throttle sensor 34 is connected to the throttle valve 14 to provide signals indicative of the degree of opening $\theta$ of the throttle valve 14 connected to an accelerator pedal (not shown). An engine cooling water temperature sensor 36 is connected to the engine body to detect a temperature of the engine cooling water, THW. An engine speed sensor 38 is connected to a crankshaft 26B or a rotary member in mechanical connection thereto, such as a distribution shaft of a distributor (not shown), to detect a rotational speed NE of the engine crank shaft 26B.

A by-pass passageway 40 is provided, having a first end connected to the intake line 10 upstream of the throttle valve 14 and a second end connected to the surge tank 16 downstream of the throttle valve 14. A by-pass air flow control valve 42, called an idling speed control (ISC) valve, is arranged in the by-pass passageway 40 for controlling the amount of air by-passing the throttle valve 14 during a closed condition thereof, i.e., idling or deceleration condition of the engine. The ISC valve 42 is connected to a step motor 43 operated by a control circuit 44 as a microcomputer system for controlling the desired variable position of the valve 42 so as to attain a required engine speed during the idling condition.

The control circuit 44 has, as essential construction units, a microprocessing unit (MPU) 44*a*, a memory 44*b*, an input port 44*c*, an output port 44*d*, and a bi-directional data and address bus 44*e*. The air flow meter 12, throttle sensor 34, engine speed sensor 38, engine cooling water temperature sensor 36, and other not shown sensors are connected to the input port 44*c* for introducing detected corresponding data. The output port 44*d* is connected to the ISC valve actuator 43, injectors 22, and other not shown operating units for issuing operating signals thereto.

Reference numeral 50 denotes an electronically operated transmission device which is composed of a torque converter 52 provided with a lock-up clutch, an over-drive portion 54, and an under-drive portion 56 with three stage forward gears and one reverse gear. The torque converter 52 is, per se, well known and is provided with a pump member 521, a turbine member 522, and a stator member 523, and in addition, it is provided with a lock-up clutch $C_L$. The pump member 521 is extended as an input shaft 525 which is in mechanical connection with the crankshaft 26B of the internal combustion engine. The turbine member 522 is extended as an output shaft 526. The lock-up clutch $C_L$ is arranged between the input shaft 525 and the output shaft 526. The lock-up clutch $C_L$ is engaged at a predetermined vehicle condition to cancel the torque converter 52 and attain a direct connection between the input and output shafts 525 and 526.

The over-drive mechanism 54 is provided with a planetary gear mechanism having a carrier 541, planetary pinions 542, sun gear 543, and ring gear 544. The carrier 541 is connected to the output shaft 526 of the torque converter 52. A one-way clutch $F_0$ and a clutch torque $C_0$ are arranged between the carrier 541 and the sun gear 543. Furthermore, a brake $B_0$ is arranged between the sun gear 543 and a position 545 of a housing around the over-drive portion 54. An output shaft 547 is extended from the ring gear 544.

The under-drive portion 56 is provided with a double planetary gear mechanism having a sun gear 560, front and rear planetary pinions 561 and 562 meshing commonly with the sun gear 560, front and rear carriers 563 and 564, and front and rear ring gears 565 and 566. The front ring gear 565 is in connection with the rear carrier 564, to provide an output-shaft 567. The rear ring gear 566 extends as an input shaft 568 of the under-drive portion 56. A clutch $C_1$ is arranged between the output shaft 547 of the over-drive portion 54 and the input shaft 568 of the under-drive portion 56. A clutch $C_2$ is arranged between the output shaft 547 and the common sun gear 560, and one-way clutches $F_1$ and $F_2$ are provided. A brake $B_1$ is arranged between the sun gear shaft 560' and a portion 56-1 of the housing around the under-drive portion 56, a brake $B_2$ is arranged between the housing portion 56-1 and the one-way clutch $F_1$ mounted on the sun gear shaft 560', and finally, a brake $B_3$ is arranged between the housing portion 56-1 and the front carrier 563 and the one-way clutch $F_2$ which is arranged between the front carrier 563 and the housing portion 56-1.

Reference numeral 60 schematically and generally designates a hydraulic control unit for operating various hydraulically operated devices in the transmission, i.e., the lock-up clutch $C_L$, the clutches $C_0$, $C_1$ and $C_2$, and the brakes $B_0$, $B_1$, $B_2$, and $B_3$. The hydraulic control unit 60 has, in a well known manner, a plurality of solenoid valves $S_1$, $S_2$, $S_3$, and $S_4$ connected to an electric control circuit 62. The solenoid valves $S_1$ and $S_2$ are provided for operating the under drive portion 56, and the solenoid $S_3$ is provided for operating the over-drive mechanism 54. The solenoid $S_4$ is provided for operating the lock-up clutch $C_L$.

A vehicle speed sensor 63 is provided for detecting the rotational speed of the output shaft 567 of the transmission corresponding to the speed of vehicle V. A shift lever position sensor 64 detects various positions of a shift lever (not shown) operated by an operator. A pattern select switch 66 is operated by an operator in a known manner to change a pattern of the transmission. An over-drive switch 68 is also operated by the driver when desiring to enter the over-drive condition in a predetermined range of the vehicle conditions.

The transmission control circuit 62 is constructed as a microcomputer system and has a microprocessing unit (MPU) 62*a*, a memory 62*b*, an input port 62*c*, an output port 62*d*, and a bi-directional data and address bus 62*e*. The input port 62*c* is connected to the various sensors and switches 34, 62, 64, 66, 68, and 70 for receiving signals therefrom. The output port 62*d* is connected to the solenoid valves $S_1$, $S_2$, $S_3$, and $S_4$ for providing operating signals thereto, for operating selected hydraulic operating device(s), i.e., clutch or brake, to attain a desired transmission pattern in accordance with the operating condition of the vehicle. It should be noted that in order to attain the torque control of the engine during the shift down operation by the automatic transmission 50, for engine braking, the output port 62*d* of the transmission control circuit 62 is connected to the input port 44*c* of the engine control circuit. Therefore, the signals from the transmission control circuit 62 directed to the shift valves $S_1$ to $S_4$ for attaining shift down operations can be introduced to the engine control circuit 44.

The following Table illustrates how the hydraulic unit (clutch and brake) are operated in accordance with positions of the shift lever, wherein P is the parking position, R is the reverse position, N is the neutral position, D is the drive position, 2 is a second speed position, and L is a low speed position.

| Position of Shift Lever | $C_0$ | $C_1$ | $C_2$ | $B_0$ | $B_1$ | $B_2$ | $B_3$ | $F_0$ | $F_1$ | $F_2$ |
|---|---|---|---|---|---|---|---|---|---|---|
| P | O | X | X | X | X | X | X | X | X | X |
| R | O | X | O | X | X | X | O | X | X | X |
| N | O | X | X | X | X | X | X | X | X | X |
| D | | | | | | | | | | |
| First Speed Range | O | O | X | X | X | X | X | Δ | X | Δ |
| Second Speed Range | O | O | X | X | X | O | X | Δ | Δ | X |
| Third Speed Range | O | O | O | X | X | O | X | Δ | X | X |
| Over-Drive Range | X | O | O | O | X | O | X | X | X | X |
| 2 | | | | | | | | | | |
| First Speed Range | O | O | X | X | X | X | X | Δ | X | Δ |
| Second Speed Range | O | O | X | X | O | O | X | Δ | Δ | X |
| Third Speed Range | O | O | O | X | X | O | X | Δ | X | X |
| L | | | | | | | | | | |
| First Speed Range | O | O | X | X | X | X | O | Δ | X | Δ |
| Second Speed Range | O | O | X | X | O | O | X | Δ | Δ | X |

Figure 2:
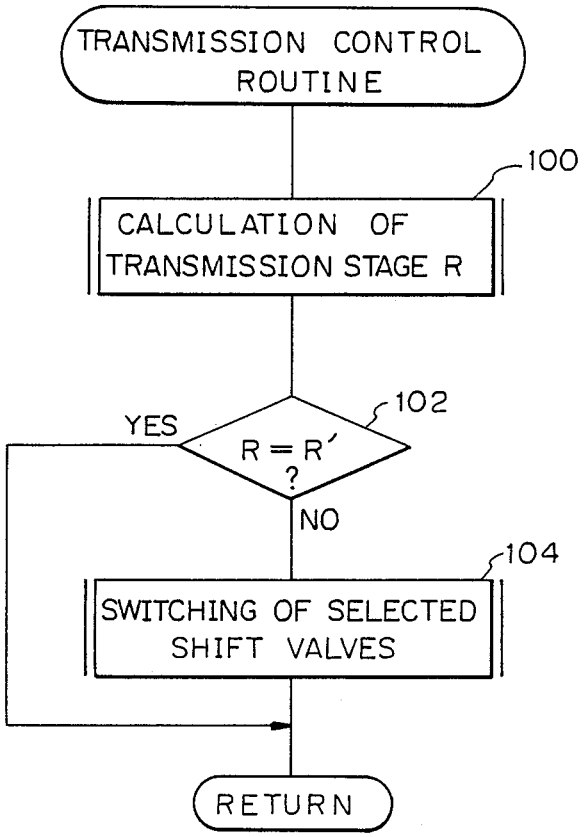
FIG. 2 generally shows a routine attained by a transmission control circuit according to the present invention.
Figure 3:
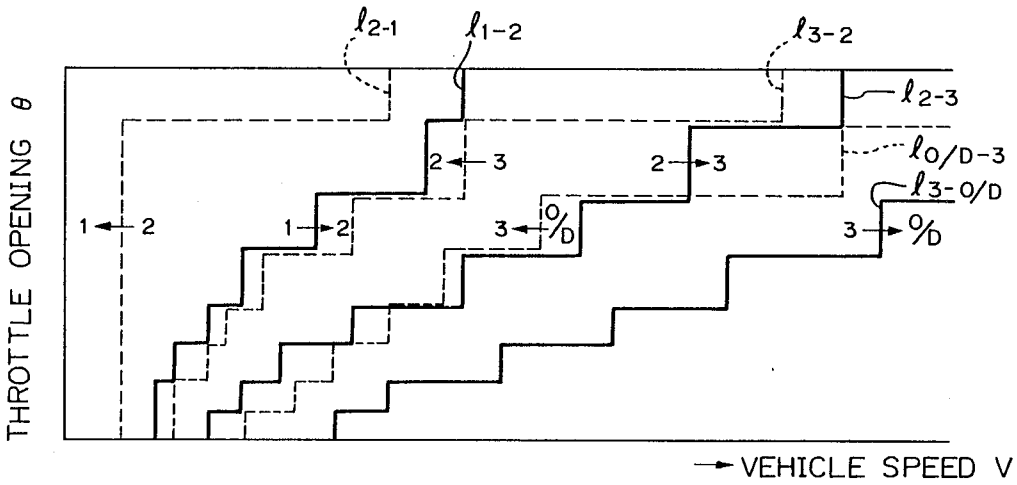
FIG. 3 shows how a shift operation is attained at the D position of the transmission device of the present invention.

In the above Table, with regard to the clutches $C_0 \sim C_2$, and brakes $B_1 \sim B_3$, O means that the corresponding unit is energized, and x that it is de-energized. With regard to the one way clutches $F_0 \sim F_2$, Δ means that the corresponding unit transmits a torque when being driven, and x means that the corresponding unit transmits a torque when being used for engine braking. The control circuit is provided with programs for attaining the control of the electromagnetic valves $S_1$, $S_2$, $S_3$, and $S_4$, so that the operation of the clutches and brakes as shown in the above Table is attained. FIG. 2 schematically illustrates a routine for controlling the hydraulic unit 60. At point 100, the number of the transmission stage R is calculated. In FIG. 3, a transmission diagram is shown in a drive range wherein the shift lever is in the D position, with the over-drive switch 68 being made ON for attaining the over-drive operation. A shiftup from a low ratio gear to a high ratio gear occurs when a vehicle condition designated by a vehicle speed V and throttle opening $\theta$ moves across a solid line $l_{1-2}$, $l_{2-3}$ or $l_{3-0/D}$, each line corresponding to a shift line from the lower speed gear to the higher speed gear, as designated by the suffix. Contrary to this, a shift down occurs when the vehicle condition moves across a dotted line $l_{0/D-3}$, $l_{3-2}$ or $l_{2-1}$, each line corresponding to a shift down from the upper speed gear to the lower speed gear, as designated by the corresponding suffix. At point 100, the speed range R matched to the engine condition is calculated from the vehicle speed V and the throttle opening $\theta$ by using data maps, which are stored in the memory 62b of the transmission control circuit 62, and which are made from selected shift diagrams, one of which is, with regard to the drive range, shown in FIG. 3. Maps similar to FIG. 3 are provided for each transmission pattern, in accordance with the position of the shift lever, switch 64, pattern select switch 66, or over-drive switch 68. These shift lines, however, can be suitably modified. For example, a gear shift between a low ratio gear and a next higher ratio gear occurs at a higher speed or throttle opening when the shift lever is in the 2 and L position, when the over-drive switch is made $\overline{\text{O}}$FF or when the pattern switch 66 is in a power mode. Therefore, a shift down is carried out when the shift lever is moved or the over-drive switch is made ON.

At point 102, it is judged if the calculated speed range R is equal to the detected speed range R'. If R=R', step 104 is by-passed. If R does not equal R', the routine goes to point 104 where the desired shift valve(s) from $S_1$ to $S_4$ is operated to operate hydraulic units as designated in the previous Table. As a result, the switch to the calculated transmission stage R is attained.

Figure 4:
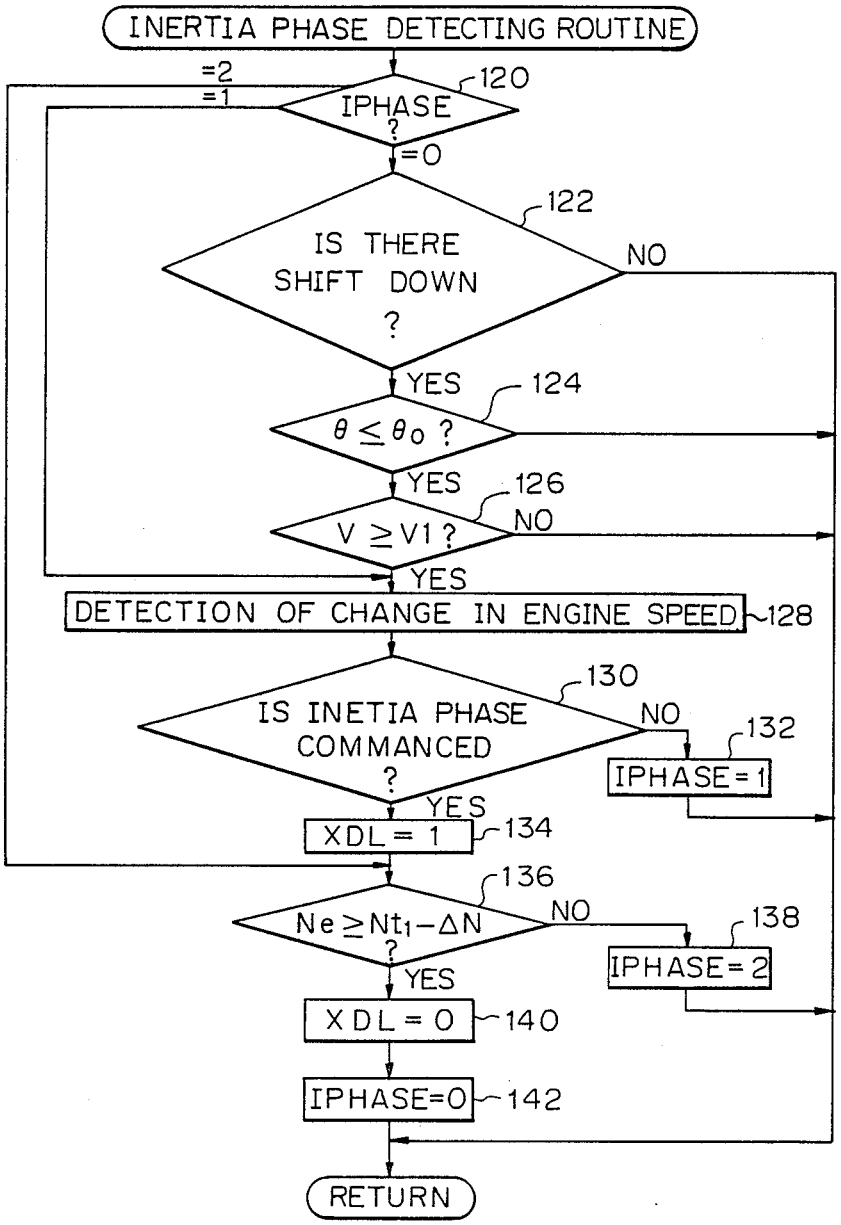
FIGS. 4 to 7 shows routines attained by an engine control circuit according to the present invention.

The engine control circuit 44 provides programs for controlling the ISC valve step motor 43, which will be described by the flow charts in FIGS. 4, 5, and 6. The control circuit 44 also has programs for controlling various engine control units, such as the injectors 22, and an ignition control system for operating the spark plugs 25, but a description thereof is omitted since they are not directly related to the present invention. FIG. 4 shows a flow chart for detecting an area for increasing the engine torque after the shift down in the automatic transmission unit is commenced by manipulation of the vehicle control devices by the driver. At point 120, it is judged whether a flag IPHASE is 1, 2, or 3. The values of the flag correspond, as will be seen later, to various phases generated after the commencement of the shift down. At point 122, it is judged whether a shift down operation is attained. This judgement can be attained, for example, by detection of the manner of change in signals directed to the shift valves $S_1$ to $S_4$. When the down-shift is attained, the routine goes to point 124, where it is judged if a degree $\theta$ of opening of the throttle valve 14 is equal to or smaller than a predetermined value $\theta_0$. At point 124, it is judged whether the value of the speed of the vehicle V is equal to or larger than a predetermined value $V_1$. A YES result at points 124 and 126 means that the vehicle is moving while the throttle valve 14 is closed for attaining an engine braking effect.

When $\theta \leqq \theta_0$ and $V \geqq V$, i.e., the vehicle is under an engine braking operation, the program goes to point 128 where the change in the engine speed is detected. At point 130, it is judged whether the so-called "inertia phase" has commenced. This judgement is attained, for example, by detecting $Nei > Ne_{i-1}$ repeated for n times, wherein Nei is the engine speed at the present time detected by the engine speed sensor 38, while $Ne_{i-1}$ is the engine speed detected by a preceding routine. When the inertia phase has not commenced, the routine goes to point 132 where a value of 1 is moved to the flag IPHASE.

When the routine enters into execution at the next time, the program goes from point 120 to 128, since IPHASE=1. When the inertia phase has commenced, the routine goes from point 130, to point 134, where the flag XDL is set. As will be described later, this allows the torque increase control by the ISC valve 42. At point 136, it is judged if the inertia phase is completed. This judgement is effected, for example, by detecting whether $Ne \geqq N_{ti} - \Delta N$, where Ne is the engine speed, Nti is a turbine speed as synchronized, corresponding to the rotational speed $N_0$ of the output 567 of the transmission 50, multiplied by a gear ratio of the lower speed gear, and $\Delta N$ is a predetermined value. When the inertia phase has not been completed, the routine goes from point 130 to point 138, where the value of 2 is moved to the flag IPHASE indicating that transmission is under the inertia phase.

When the following routine enters into execution, the routine goes from point 120 to point 136, since the flag IPHASE is 2. If the inertia phase is completed, the routine flows to point 140, where the flag XDL is cleared, and then to point 142, where the flag IPHASE is cleared, to stop any torque increase operation as will fully described later.

Figure 5:
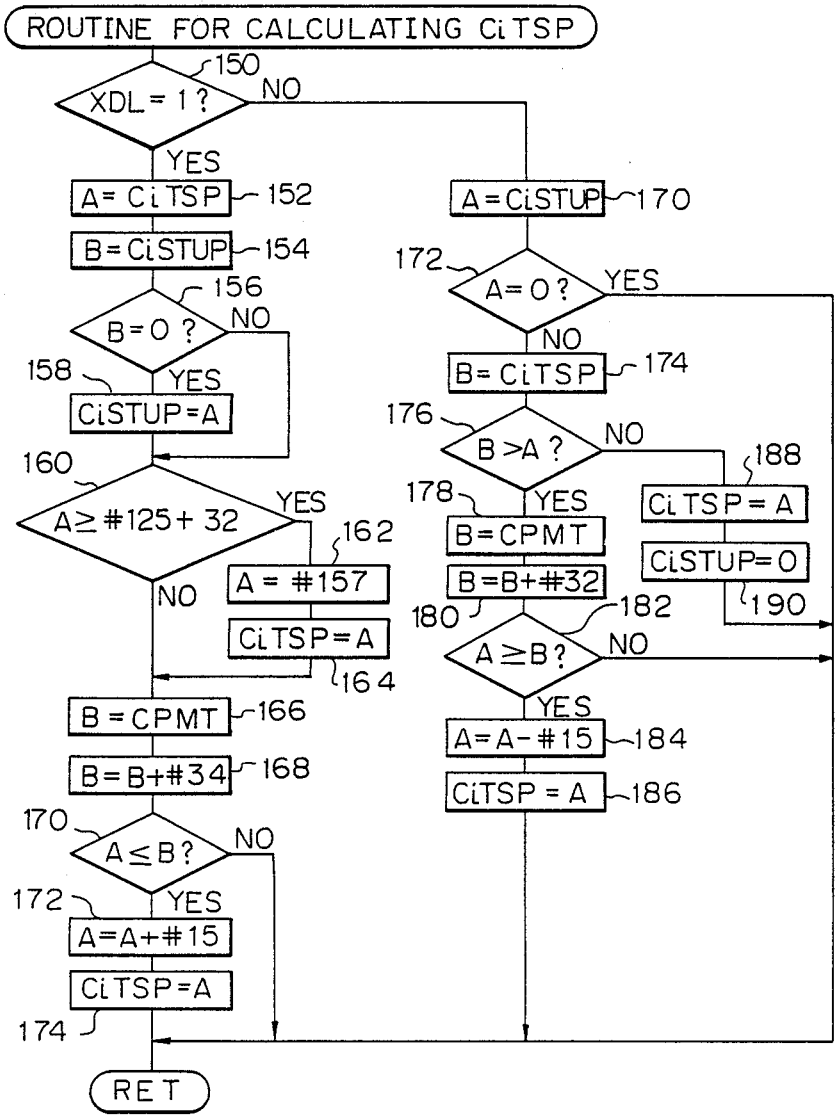

FIG. 5 shows a routine for determining the amount of increase in the air passing through the ISC passageway 40, for increasing engine torque during the inertia phase operation. The routine is executed at predetermined intervals. At point 150, it is judged whether the flag XDL=1. A YES result at point 150 means that the transmission system 50 is under the inertia state, which requires an increase in the engine torque. In this case, the routine goes to point 152, where a value of a memory area for storing CiTSP indicating a target number of steps of the step motor 43 to be increased for increasing the engine torque is moved to a register A. In accordance with the step number CiTSP, the degree of opening of the SC valve 42 is increased, and therefore, the amount of the intake air is increased, thus the engine torque must be correspondingly increased. At point 154, a value of a memory area for storing CiSTUP, indicating a number of steps of the step motor 43 before entering the torque increase control of the present invention, is moved to the register B.

Figure 8:
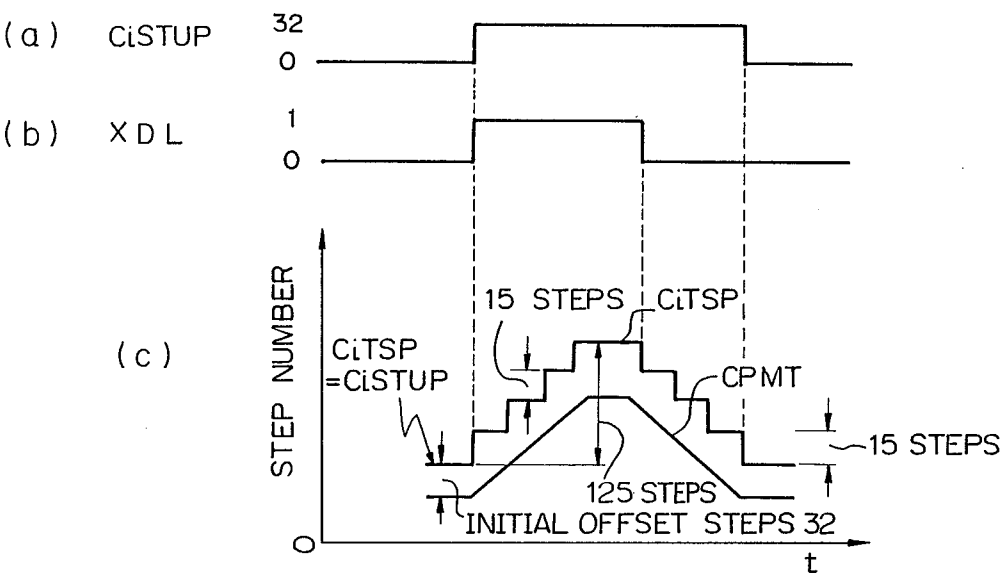
FIG. 8 is a timing chart showing the change in ISC step number of the step motor during engine torque control; and, FIG. 9 is a timing chart showing changes in various factors according to the present invention.

At point 156, it is judged whether B=0. In the normal idling operation, as shown in FIG. 8-(*a*), the value of CiSTUP moved to the register B is zero, and therefore the routine goes initially to point 158, where the value of the register A is moved to CiSTUP. The register A stores, at this instant, a value of 32 (initial offset value) as a result of the execution of step 188 during the preceding routine wherein no torque increase is necessary.

At point 160, it is judged if the value of the register A is equal to or larger than the maximum value 125 of the target value of the step number of the step motor 44, added by an offset step number 32, that is 157. In place of fixing the value of the maximum value to 125, as realized in this embodiment, it may be changed (decreased) in accordance with the vehicle condition, such as the type of change in speed range or vehicle speed.

When the result of the judgement at point 160 is YES, the program goes to point 162, where 157 (125+32) is moved to the counter A, and to point 164 where the value of the counter, that is 157, is moved to CiTSP. The steps 162 and 164 are a so called "guard" procedure used to prevent the value therein from being increased above the maximum value.

At point 166, an actual value of a step number of the step motor 43 at the present time, CPMT, is moved to the register B. At point 168, the value of the register B is incremented by a number 34, which is larger than the initial offset step number 32. At point 170, it is judged if $A \leqq B$. A YES result at point 170 means that the actual step number CPMT of the step motor 44 has approached the step number difference (CiTSP−34). In this case, the routine goes from point 170 to point 172, where A is incremented by 15, and to point 174, where the value of the counter A is moved to CiTSP. The step-like increase in the value of CiTSP toward the target value of the increase in step number, that is 125 steps, serves to prevent a guard routine from being operated, which guard routine is provided for commencing a fail safe routine when the increase in the step number becomes larger than a predetermined number, such as 17. Since the step number is increased, 15 in the routine of FIG. 5 is smaller than this value 17, and the guard routine does not operate.

The opening of the ISC valve 43 is, in the above manner, increased for increasing the intake air amount passed through the ISC by-pass passageway 40, until the target value CiTSP is equal to or larger than the maximum value 127+32=157 or the flag XDL is changed to "0". The changes of CiTSP and CPMT are schematically illustrated in FIG. 8-(*c*).

The routine for decreasing the step number for returning to a normal operation will be described hereinbelow. At the end of the inertia phase, the flag XDL is cleared (point 140 is FIG. 4). therefore, the routine goes from point 150 to 170, where the content in CiSTUP is moved to the A register, in which 32 is stored at this stage. At point 172, it is judged if a value of the A register is zero. Initially, a NO result is obtained, and therefore, the routine goes to point 174 where the value of CiTSP, which initially is equal to 157, is moved to the B register. At point 174, it is judged if the value of the A register is larger than the value of the B register. Initially the routine flows to point 178 where the value of the present step number of the step motor 43 is moved to the B register, and to point 180 where the value of the B register is incremented by 32. At point 182, it is judged if the value of the A register is equal to or larger than the value of the B register. Initially, the result of the judgement at point is NO, and therefore, the routine after point 184 is by-passed. When the actual step number of the step motor 43 is decreased within a difference (CiTSP−32) , then the routine goes from point 182 to point 184, where the value of the A register is decremented by 15, and to point 186 where the value of the A register is moved to CiTSP.

When the target value of the step number of the step motor 43, CiTSP is decreased to be equal to or lower than the initial set value 32 in CiSTUP. The routine flows from point 176 to point 188, where the value of the A register, that is 32, is moved to CiTSP, and to point 190, where the value of zero is moved to CiSTUP.

In this way, as shown in FIG. 8-(*c*), the degree of opening of the ISC valve 42 is gradually decreased so that the amount of intake air passed through the ISC by-pass passageway is decreased, until the target value CiTSP is decreased to the initial off set value (32), to cancel any torque increasing operation.

Figure 6:
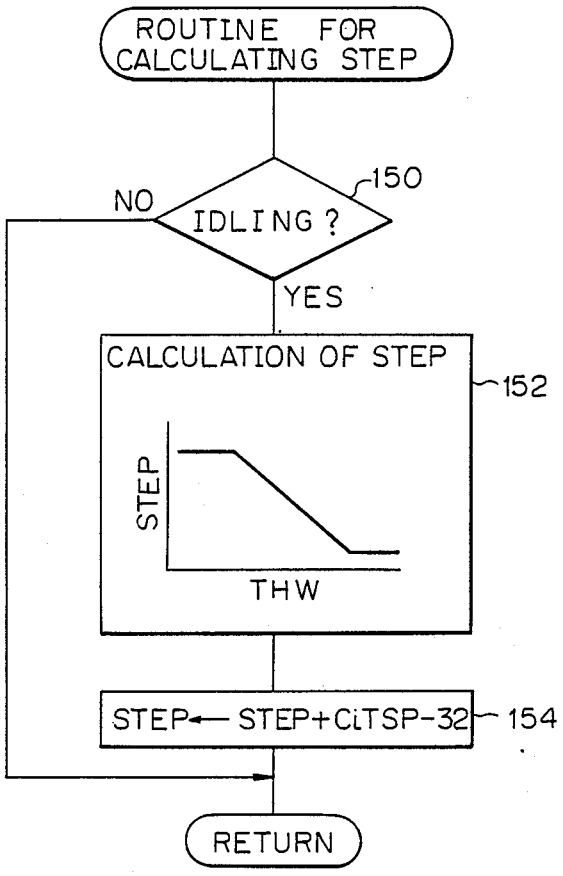

FIG. 6 shows a routine for calculating STEP, which is the total number of steps corresponding to the position of the step motor 43, i.e., the amount of intake air passing through the ISC passageway 40 corresponding to the engine idling speed. At point 150, it is judged if the engine is in an idling condition, wherein the throttle valve 14 is substantially fully closed. When the engine is idling, the routine goes to point 152, where a STEP corresponding to the engine idling speed is calculated. The memory 44*b* is provided with a map indicating the relationship between the engine cooling water temperature THW and the value of STEP. An extrapolation is effected in order to calculate, from the map, a value of STEP corresponding to a sensed value of the engine cooling water temperature THW sensed by the sensor 36. At point 154, a sum of the STEP calculated at point 152 and the CiSTP calculated by the routine of FIG. 4 subtracted by the initial offset value of 32, is moved to STEP. As already described, CiTSP usually has a zero value, and has a value of 125 during engine braking, to increase engine torque.

Figure 7:
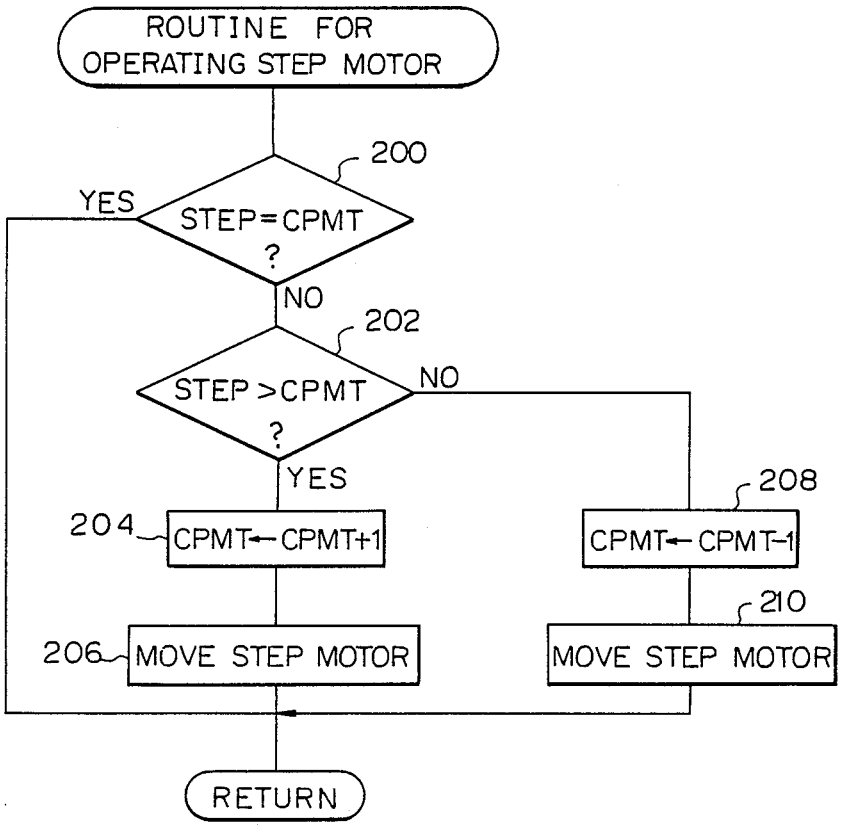

FIG. 7 illustrates a routine for attaining control of the step motor 44. This routine enters into calculation at predetermined intervals for allowing a one step rotation of the step motor 43. At point 200 it is judged if a target value of the position of the step motor, STEP, is equal to the actual value of the position of the step motor 43 CPMT. If the result of the judgement is NO, the routine goes to point 202 when it is judged if STEP>CPMT. When the actual position of the step motor 43 has not yet reached the calculated position, the routine goes to point 204, where CPMT is incremented by 1, and to point 006 where the step motor 43 is operated to rotate for one step in the forward direction. When the actual position of the step motor 43 has passed the calculated position, the routine goes from point 202 to point 208, where CPMT is decremented by 1, and to point 210 where the step motor 43 is operated to rotate for one step in the reverse direction. As a result of this routine, the actual position and the calculated position are maintained as equal to each other.

FIG. 8-(*c*) shows changes in the step number. In a normal idling operation, the position of the step motor, STEP, is controlled to maintain a preset speed determined by step 150 in FIG. 6. When an inertia phase is detected (XDL is 0 to 1), the target value CiTSP begins to increase in a step like manner, while the actual position of the step motor CPMT is gradually increased until a predetermined increase of the step number, (125 steps) is obtained. When the inertia phase is ended (XDL is 1 to 0), the target value CiTSP begins to decrease in a step like manner, while CPMT is gradually decreased to a value for attaining the normal idling operation.

Figure 9:
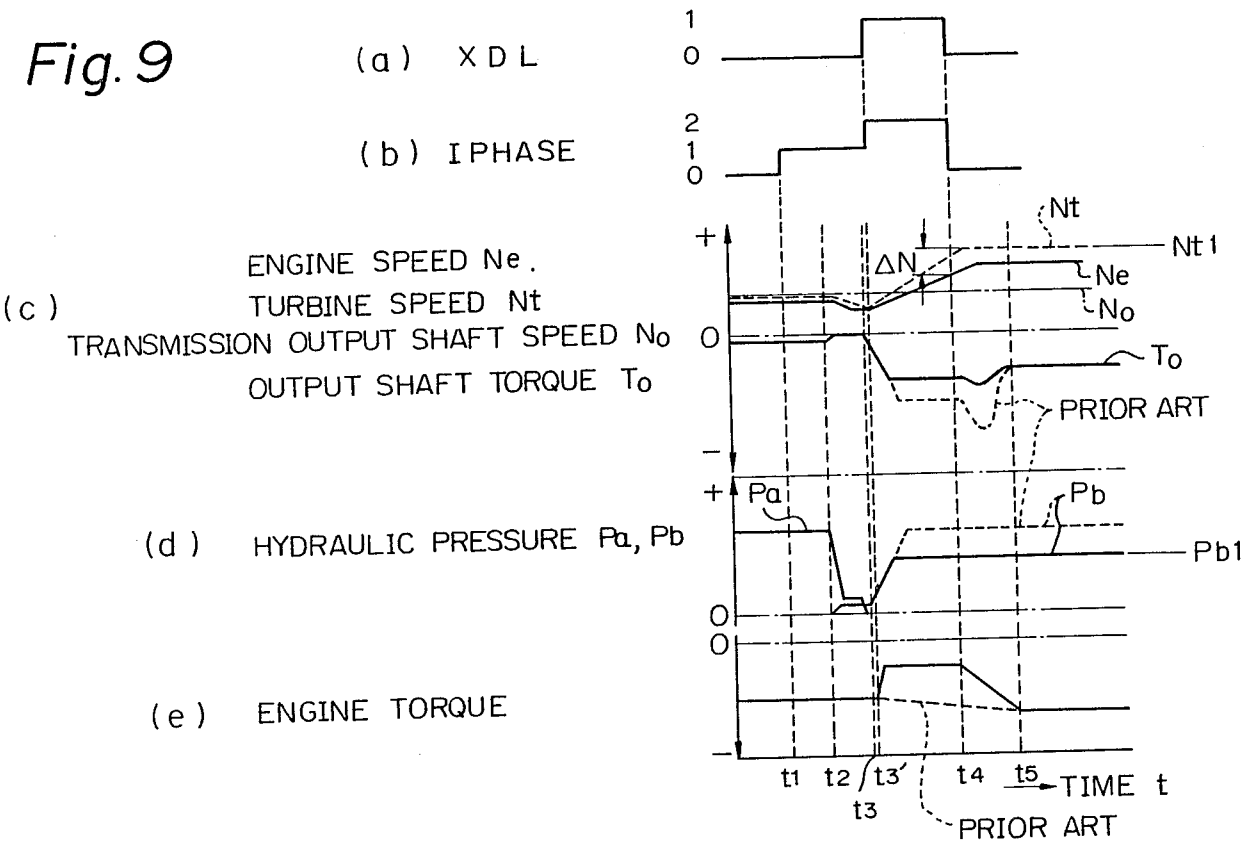

FIG. 9 illustrates the change in various parameters during the shift down operation for engine braking. Pa is a hydraulic pressure in the servo control circuit for the friction engagement unit of the high gear ratio, and Pb is a hydraulic pressure in the servo control circuit for the friction engagement unit of the low gear ratio. At time $t_1$, the shift lever is moved from the D position to the 2 or L position for attaining a shift down operation for engine braking. As a result, the phase 1 is commenced as shown in FIG. 9-(*b*) and the switching of the desired shift levers $S_1 \sim S_4$ is commenced. At time $t_2$, the hydraulic pressure for operating the desired frictional engagement units, clutch or brake, is changed, so that the pressure Pa for the high gear ratio stage begins to decrease, and the pressure Pb for the low gear ratio stage begins to increase. At time $t_3$, the frictional engaging unit for the low gear ration stage begins to engage, and at time $t_3'$, the engine speed Ne begins to increase. Synchronously with the increase in the engine speed Ne, the flag XDL is set (FIG. 9-(*a*)) as a result of the execution of the routine of FIG. 4, to enter into the phase 2 as shown by FIG. 9-(*b*), so that the routine as shown in FIG. 5 is commenced, to increase engine torque as shown in FIG. 9-(*e*).

The upper limit value of the hydraulic pressure Pb for the frictional engagement unit for the lower gear ratio stage is a smaller value than that of the prior art shown by the dotted line in FIG. 9-(*c*). The quick increase, however, in engine speed, as in the prior art, can be obtained due to the engine torque increase routine attained in accordance with the present invention, as shown in FIG. 9-(*e*). Since the hydraulic pressure for the frictional engagement unit for the lower gear ratio stage is low, the service life thereof can be prolonged. Furthermore, the decrease in the output torque To becomes, as shown by a solid line in FIG. 9-(*c*), lower than the prior art as shown by a dotted line, and thus shock generate during a shift operation can be suppressed.

At time $t_4$, the engine speed Ne has reached a value synchronized with the turbine speed of $NT_1$ (equal to a value synchronized with the speed of the turbine $N_t$ of the torque converter 52) subtracted by a predetermined value $\Delta N$. As a result, a flag XDL is cleared for moving the position of the step motor 43 toward the normal position by gradually decreasing the step number. Due to such a gradual decrease in the engine torque a change in the transmission output shaft torque $T_0$ is prevented.

In the embodiment, the idling air amount during the shift down for engine braking is controlled by the ISC valve. This is very advantageous, since the existing valve member for idling control can be used. Similarly, in place of the ISC, other means such as an idle-up system for an air conditioning device for a vehicle passenger room or a power steering system can be utilized.

In this embodiment, in order to detect the timing for starting or stopping the torque increasing operation, the inertia phase is detected by detecting the change in the engine speed. In place of this, a predetermined time from the beginning of the command for a shift operation can be detected for attaining the torque increase operation. In this case, in place of block 130 in FIG. 4, a timer is provided. The timer is started by the shift down operation for engine braking. In place of block 136 of FIG. 4, a timer detects the duration of a period after the flag XDL is set. This time corresponds to the duration of the inertia phase. When this time has lapsed, the flag XDL is reset to cancel the torque-up operation.

While the present invention is described with reference to the attached drawings, many modifications and changes can be made by those skilled in this art without departing from the scope and spirit of the invention.

We claim:

1. In a system for controlling engine idling speed for an internal combustion engine of a vehicle provided with an automatic transmission, the engine being provided with an intake line and a throttle valve arranged therein, said system comprising:

a by-pass passageway connected to the intake line so as to by-pass the throttle valve;

valve means arranged in the by-pass passageway for controlling the amount of air passing therethrough;

means for calculating the degree of opening of the valve means corresponding to a preset parameter corresponding to an intake air amount during a substantially fully closed condition of the throttle valve; and means for producing a signal directed to the valve means for operating the same so that the actual opening of the valve means corresponds to the opening calculated by the calculating means, the improvement wherein the system further comprises apparatus for decreasing shock when the automatic transmission is downshifted, the apparatus comprising means for detecting a shift down operation of the automatic transmission while the vehicle is in an engine braking condition wherein the net torque output of the engine is negative; and means for modifying the calculated degree of opening of the throttle bypass valve means so that the amount of air is increased during the shift down operation, thereby reducing the engine pumping inertia.

2. A system according to claim 1, wherein said detecting means comprises first means for detecting a command for a shift down operation of the transmission, second means for detecting an engine braking condition, and third means for detecting a transient state wherein an actual shift down operation is being carried out by the automatic transmission after the command has been issued, the modification by the modifying means being attained during the transient state.

3. A system according to claim 2, wherein said third detecting means comprises means for detecting a beginning of an inertia state in the transmission for starting modification by the modifying means, and means for detecting the timing near to the end of the increase in the engine speed for stopping the modification.

4. A system according to claim 1, further comprising means for detecting a transition between a normal negative torque state and a less negative torque state and the modifying means comprises means for gradually changing the degree of modification during the transition between the two states.

5. A system according to claim 4, wherein said valve means comprises a valve member and a step motor connected to the valve member, and said gradually changing means comprises means for calculating a target value which changes between an initial offset value and a maximum number corresponding to a predetermined positive torque change plus an offset value, and means for changing the target value in a step like manner as the actual position of the step motor approaches the maximum number.

* * * * *